US006902501B2

(12) United States Patent
Morrow et al.

(10) Patent No.: US 6,902,501 B2
(45) **Date of Patent: *Jun. 7, 2005**

(54) LACROSSE STICK HEAD

(75) Inventors: David Morrow, Farmington Hills, MI (US); Jesse Hubbard, Troy, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/414,178

(22) Filed: Apr. 15, 2003

(65) Prior Publication Data

US 2003/0195064 A1 Oct. 16, 2003

Related U.S. Application Data

(63) Continuation of application No. 09/862,012, filed on May 21, 2001, now Pat. No. 6,561,932.

(51) Int. Cl.[7] ..... A63B 59/02; A63B 65/12

(52) U.S. Cl. ..... 473/513; D21/724

(58) Field of Search ..... 473/513, 415, 473/478, 510; D21/724

(56) References Cited

U.S. PATENT DOCUMENTS

| | | | | | |
|---|---|---|---|---|---|
| 1,459,389 | A | * | 6/1923 | Brown | 473/513 |
| 3,507,495 | A | | 4/1970 | Tucker et al. | |
| 4,138,111 | A | * | 2/1979 | Rule | 473/513 |
| 5,048,843 | A | * | 9/1991 | Dorfi et al. | 473/513 |
| 5,178,397 | A | * | 1/1993 | Brine, Jr. | 473/513 |
| 5,290,039 | A | * | 3/1994 | Cornelio | 473/513 |
| 5,568,925 | A | * | 10/1996 | Morrow et al. | 473/513 |
| 6,066,056 | A | * | 5/2000 | Morrow | 473/513 |
| 6,561,932 | B2 | * | 5/2003 | Morrow et al. | 473/513 |

FOREIGN PATENT DOCUMENTS

CA 2322830 9/1999

OTHER PUBLICATIONS

Warrior Lacrosse, Inc. catalog, Revolution and Evolution lacrosse heads.
American Indian Lacrosse, 1993 by the Smithsonian Institute, 2 pages.
Warrior Lacrosse, Inc., catalog, Revolution and Evolution lacrosse heads.

* cited by examiner

*Primary Examiner*—Gregory Vidovich
*Assistant Examiner*—M. Chambers
(74) *Attorney, Agent, or Firm*—Artz & Artz, PC

(57) ABSTRACT

A lacrosse head for use with a lacrosse handle includes a frame element including an arcuate wall, a scoop opposing the arcuate wall, and a pair of opposing sidewalls. The sidewalls generally extend between the arcuate wall and the scoop. The frame element has a socket extending rearwardly therefrom for receipt of a handle therein. The lacrosse head has a plurality of net attachment means formed therein for attachment of lacrosse net thereto. The lacrosse head has a pocket area defined by a lower portion of the arcuate wall, the scoop, and a lower portion of each of the pair of opposing sidewalls. The lacrosse head also has a catching area defined by an upper portion of the arcuate wall, the scoop, and an upper portion of each of the pair of opposing sidewalls. The catching area of the head is larger than the pocket area.

90 Claims, 4 Drawing Sheets

LACROSSE STICK HEAD

CROSS-REFERENCE TO RELATED APPLICATIONS

This present application is a continuation of U.S. patent application Ser. No. 09/862,012, filed on May 21, 2001, which is now U.S. Pat. No. 6,561,932.

TECHNICAL FIELD

The present invention relates generally to a lacrosse head and, more particularly, to a lacrosse head for a lacrosse stick that can more accurately locate a lacrosse ball in the pocket of the head and therefore provide improved ball control, retention, and playability.

BACKGROUND OF THE INVENTION

Current lacrosse heads are typically constructed of an open frame having a base with a concave interior surface that defines a ball rest, a pair of sidewalls that diverge from the base, and a lip or scoop that interconnects the sidewalls remotely of the base. Openings or other attachment structures are carried by the frame for securing a lacrosse net around the back side of the frame, leaving the opposing front side of the frame open for receiving lacrosse balls. A throat or other structure exteriorly projects from the base of the frame and has a socket formed therein for attachment to a handle. The handle and throat attachment define a handle/head axis, which typically, although not necessarily forms, the central axis and/or an axis of lateral symmetry of the head. All or at least a major portion of the front side of the head is conventionally disposed in a plane parallel to the handle/head axis.

More recently, however, lacrosse heads have been commercially introduced that have a portion of the sidewall disposed below the handle/head axis. For example, U.S. Pat. No. 5,568,925 to Warrior Lacrosse discloses one embodiment for a scooped lacrosse head where the sidewall curves downward below and away from the handle/head axis and then curves upward back toward the axis. The scooped lacrosse head possesses numerous advantages over conventional lacrosse head constructions in which the front side of the frame is disposed essentially or entirely in a plane that lies parallel to the upper surface of the lacrosse stick. The curved sidewalls of the lacrosse head disclosed in the '925 patent naturally channel the lacrosse ball into the "sweet spot" or pocket of the net. Further, the pocket of the net will typically have a deeper construction than with conventional heads, such that the lacrosse ball lies a further distance below the upper rims of the sidewalls. Moreover, the arched scoop-like construction of the head, and the consequent scooped construction of the net attached to the head, provides a greater distance for the ball to travel in the net during a throwing motion, thereby improving both ball speed and "feel."

Other lacrosse heads have been commercially introduced that abruptly lower the sidewall of the lacrosse head such that the upper rims of the sidewalls lie at or below the centerline of the lacrosse stick. Purported examples of these commercial lacrosse heads are disclosed in U.S. Pat. Nos. 5,651,549 and 5,935,026. According to these patents, lacrosse heads of this configuration can provide a lacrosse stick that has a weight distribution between the stick head and handle such that the head will naturally return to a neutral or open position. Also, according to these patents, this configuration can provide improved player feel, which facilitates cradling, throwing and receiving of a ball. Furthermore, the offset head's natural rotation to an open position as disclosed in these patents minimizes the chance of a player unintentionally receiving a thrown ball with the wrong side of a lacrosse head.

While these head configurations, which vary from the traditional configuration, provide different characteristics with regard to playability and feel, they do not address the concern of maintaining a lacrosse ball in the head once received in the netting. Attempts have been made in this regard to provide structure for a lacrosse head that helps maintain a lacrosse ball in the pocket and help to resist it from being checked from the lacrosse head, but these structures have caused other problems. For example, U.S. Pat. No. 6,066,056 discloses a plurality of ball retaining ridges protruding from the interior surface of the sidewalls. Each ridge has an underside extending generally downwardly and outwardly toward the ball pocket and serves to direct and retain the ball within the pocket. However, the extensions of these ridges from the sidewalls into the pocket also decreases the effective catching area of the lacrosse head. Additionally, U.S. Pat. No. 5,048,843 discloses a lacrosse head having a base portion that is recessed or rounded in a direction opposite the open frame to assist in retaining a lacrosse ball therein. The '843 patent also discloses a recessed padded ball stop to assist in the same purpose. Other commercial lacrosse heads have pinched in the upper portions of the sidewall such that the sidewalls angle outwardly therefrom. This configuration does provide some ball retention attributes, but it decreases the catching area of the head.

None of these prior lacrosse heads, however, provide any structure to narrow the pocket of the head and thereby keep the lacrosse ball, while in the head, in line with the center of the stick without narrowing the effective catching area of the head. Rather, in an effort to provide a wide catching area, these heads allow for a significant amount of side-to-side movement of the ball between the bottom portions of the sidewalls.

SUMMARY OF THE PRESENT INVENTION

Accordingly, it is an object of the present invention to provide a lacrosse head that is configured with a narrow pocket to keep the ball in line with the centerline of the stick.

It is a related object of the present invention to provide a lacrosse head with the bottom portions of opposing sidewalls being narrower than the top portions of the opposing sidewalls.

It is a further object of the present invention to provide a lacrosse head that prevents wear of the stringing when the ball resides in the lacrosse head.

It is another object of the present invention to provide a lacrosse head that provides a decreased pocket area for better ball retention without decreasing the size of the catching area.

It is still another object of the present invention to provide a lacrosse head that assists in preventing the lacrosse ball from being dislodged from the head during use.

It is still a further object of the present invention to provide a lacrosse head with a throat configuration that is stronger and lighter than prior lacrosse heads.

In accordance with the above and other objects of the present invention, a lacrosse head for a lacrosse stick is provided. The lacrosse head has an open frame having a rearward base, a lip or scoop opposing the base, and a pair of sidewalls extending between the base and the lip. The lacrosse head has a throat portion projecting rearwardly from the open frame for receipt of a lacrosse stick element therein so as to define a head/handle axis projecting forwardly of the throat portion. The open frame has a plurality of net securing structures carried thereon for securing a lacrosse net along a back side of the frame, leaving an opposing front side of the frame open for receiving a lacrosse ball. Each of the pair of sidewalls has a bottom portion and a top portion. Each of the sidewalls curves generally outward as it extends upward from the bottom portion to the top portion, such that the top portions of the sidewalls are located a further distance apart than the bottom portions of the sidewalls.

In accordance with another object of the present invention, the bottom portion of each sidewall has a recessed shoulder that is stepped back with respect to each sidewall surface. The plurality of net securing structures are disposed in the shoulder.

These and other features and advantages of the present invention will become apparent from the following description of the invention, when viewed in accordance with the accompanying drawings and appended claims.

DETAILED DESCRIPTION OF THE PREFERRED EMBODIMENTS

Figure 1:
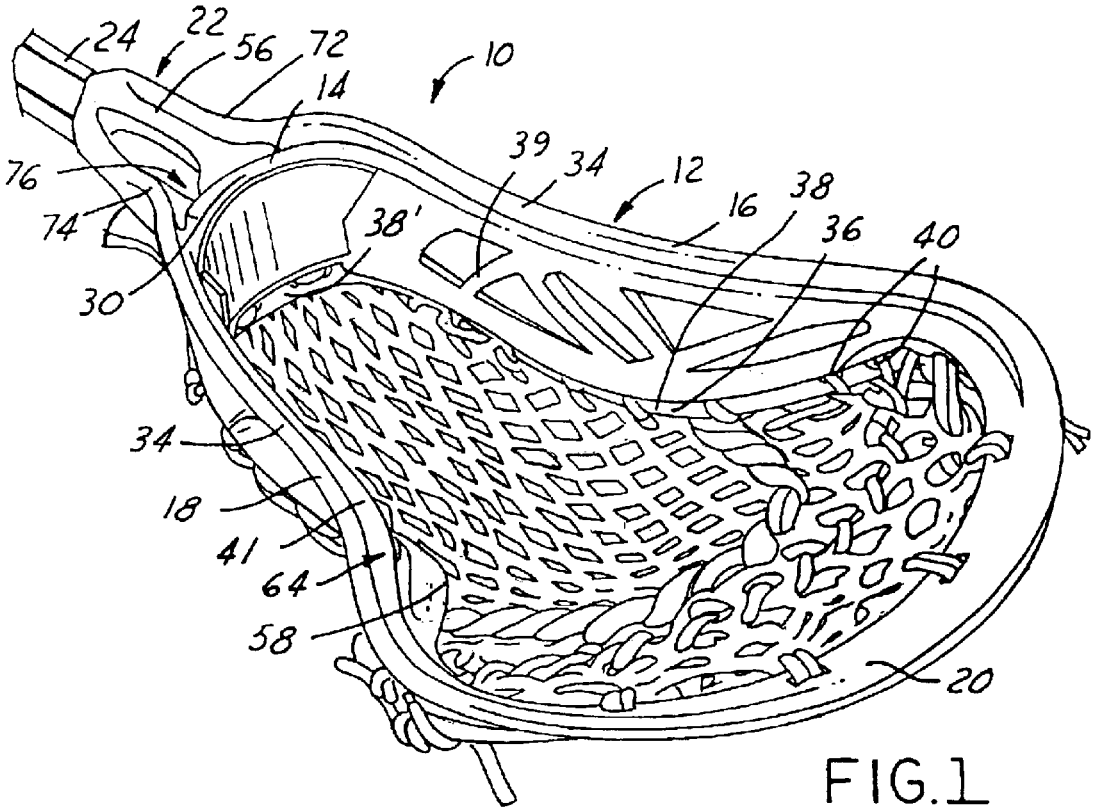
FIG. 1 is a top perspective view of a lacrosse head and attached handle in accordance with a preferred embodiment of the present invention.
Figure 2:
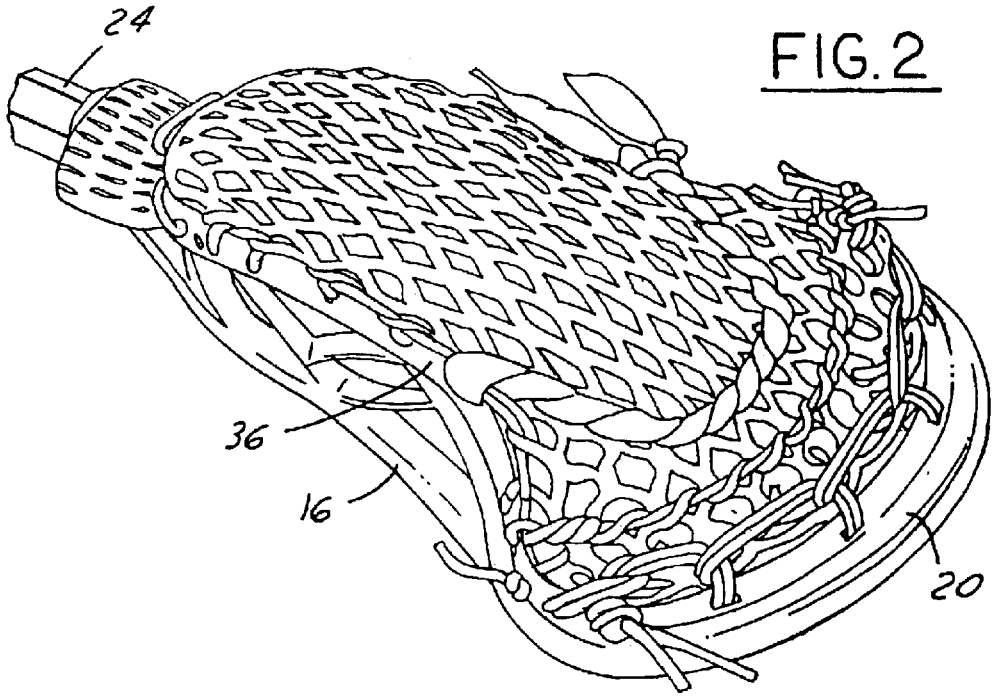
FIG. 2 is a bottom view of a lacrosse head and attached handle in accordance with a preferred embodiment of the present invention.
Figure 4:
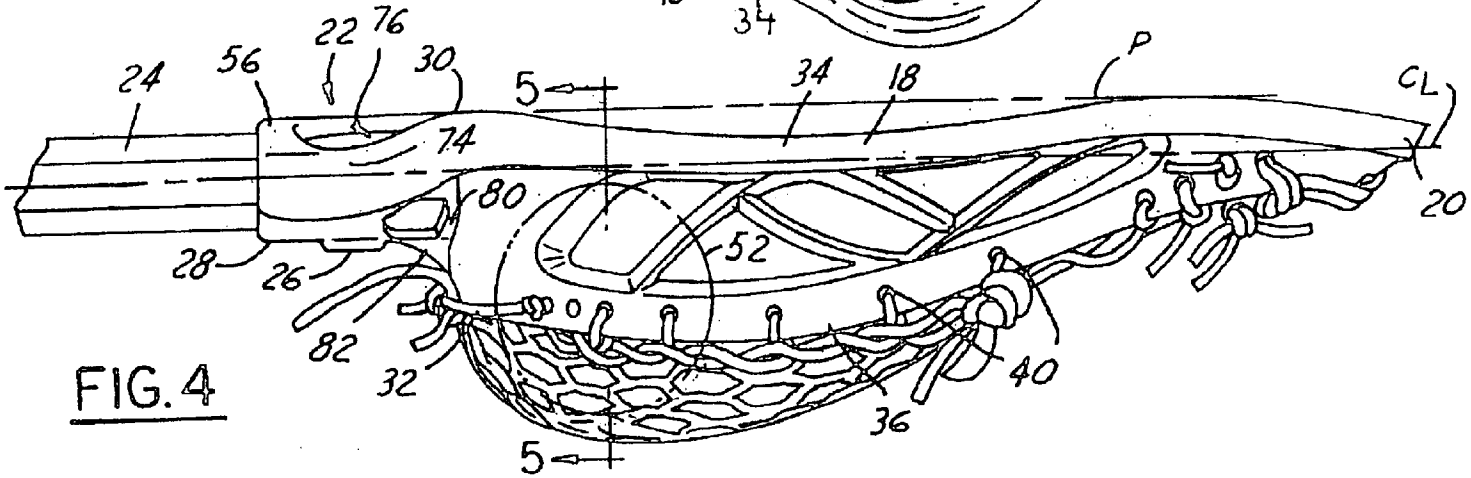
FIG. 4 is a side view of a lacrosse head and attached handle in accordance with a preferred embodiment of the present invention.

Referring now to FIGS. 1 and 2, which illustrate a lacrosse head 10 in accordance with the present invention. The lacrosse head 10 has a frame element 12, which includes a base or arcuate wall 14, a pair of opposing sidewalls 16, 18, and a scoop or lip 20 connecting the pair of opposing sidewalls 16, 18 opposite the base 14. The lacrosse head 10 has a throat or socket 22 that extends generally rearwardly from the frame element 12 for attachment of a stick handle or element 24 therein. The stick handle 24 is preferably secured in the socket 22 by a securing means, such as a screw or the like, which is inserted into a fixation hole 26 formed in the socket 22. The fixation hole 26 is preferably formed in a lower surface 28 of the socket 22 (FIG. 4). However, it should be understood that the fixation hole 26 can be formed in any portion of the socket 22.

The base 14 has an upper rim 30 and a lower rim 32. Additionally, the sidewalls 16, 18 each have an upper rim 34 and a lower rim 36. The lower rims 36 of each of the sidewalls 16, 18 are preferably recessed with respect to the sidewalls 16, 18 to form a recessed channel 38. The recessed channel 38 is recessed outwardly with respect to an inner surface 39, 41 of each sidewall 16, 18. Similarly, the lower rim 32 of the base 14 is preferably recessed with respect to the base 14 to form a recessed channel 38'. The recessed channels 38, 38' preferably have a plurality of net securing structures 40 located therein. The net securing structures 40 are preferably stringing holes that are formed through the head to allow attachment of the netting. However, it will be understood that a variety of other net securing structures may be utilized. By locating the net securing means 40 in the recessed channels 38, 38', undue wear on the netting is prevented when the ball is received into or shot or passed from the lacrosse head 10. In addition to protecting the net from abrasion, the recessed channels 38, 38' greatly facilitate ball control during play. Further, the recessed channels 38, 38' allow the lacrosse ball to rest more deeply in the pocket of the net and throat of the head than in the case of prior art constructions.

The recessed channel 38 in each sidewall preferably has a top surface 42, which extends outwardly from and generally perpendicular to each of the sidewalls 16, 18 and an outer surface 44, which extends generally downwardly from and generally perpendicularly to the top surface 42 towards the lower rim 32. This provides a generally stepped back configuration. The recessed channel 38 is preferably integrally formed in the lower portion of the sidewalls 16, 18. In addition to protecting the stringing, the recessed channel 38 also acts as a seat for the ball when it is in the netting. The recessed channel 38 thus enhances the ability of the player to retain and secure the ball in the lacrosse head 10 while also facilitating play of the ball from the head 10. It will be understood that instead of two surfaces 42, 44, the recessed channel 38 could be configured as a single curved surface, an outwardly slanting surface or other similar shape.

Figure 5:
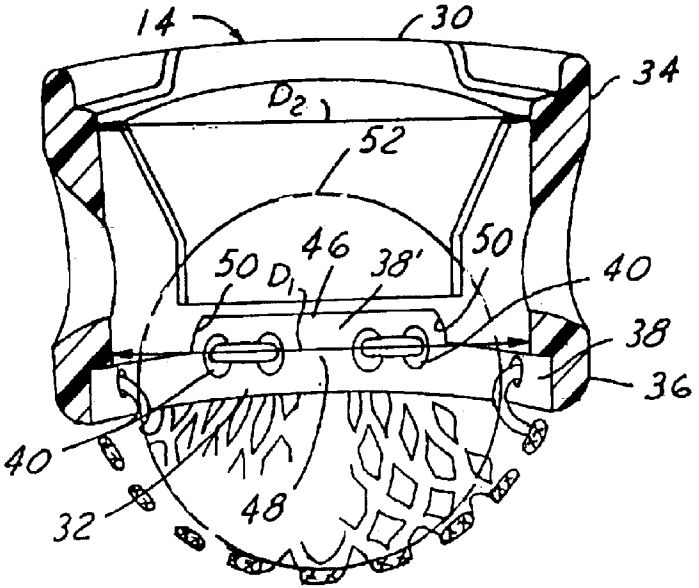
FIG. 5 is a cross-sectional view of a lacrosse head along the line 5—5 in FIG. 4.

As shown best in FIGS. 1 and 5, the recessed channel 38' has a top surface 46 that extends outwardly and generally perpendicular from the base 14 and a rear surface 48 that extends downwardly and generally perpendicularly from the top surface 46 to the lower rim 32. The recessed channel 38' has a pair of side portions 50 that extend generally between the top surface 46 and the rear surface 48 and preferably connect at a lower end with the channel 38 form in either sidewall 16, 18. This also provides a generally stepped back configuration. The enlarged recessed channel 38' at the base 14 allows a portion of the lacrosse ball 52 to rest therein, when the ball is carried in a typical pocket formed adjacent the base 14. The recessed channel 38' thus also enhances the ability of a player to retain and secure the ball in the lacrosse head 10. It will be understood that the recessed channel 38 in the sidewalls 16, 18 can be the same size as the recessed channel 38' in the base 14. Also, instead of a variety of different surfaces 46, 48, 50, the recessed channel 38' could be configured in a variety of different ways, including curved, angled, or slanted. The base 14 also preferably has a foam resilient padding or ball stop 54 applied to its inner surface to cushion the impact of the ball when in contact with the base 14.

Figure 3:
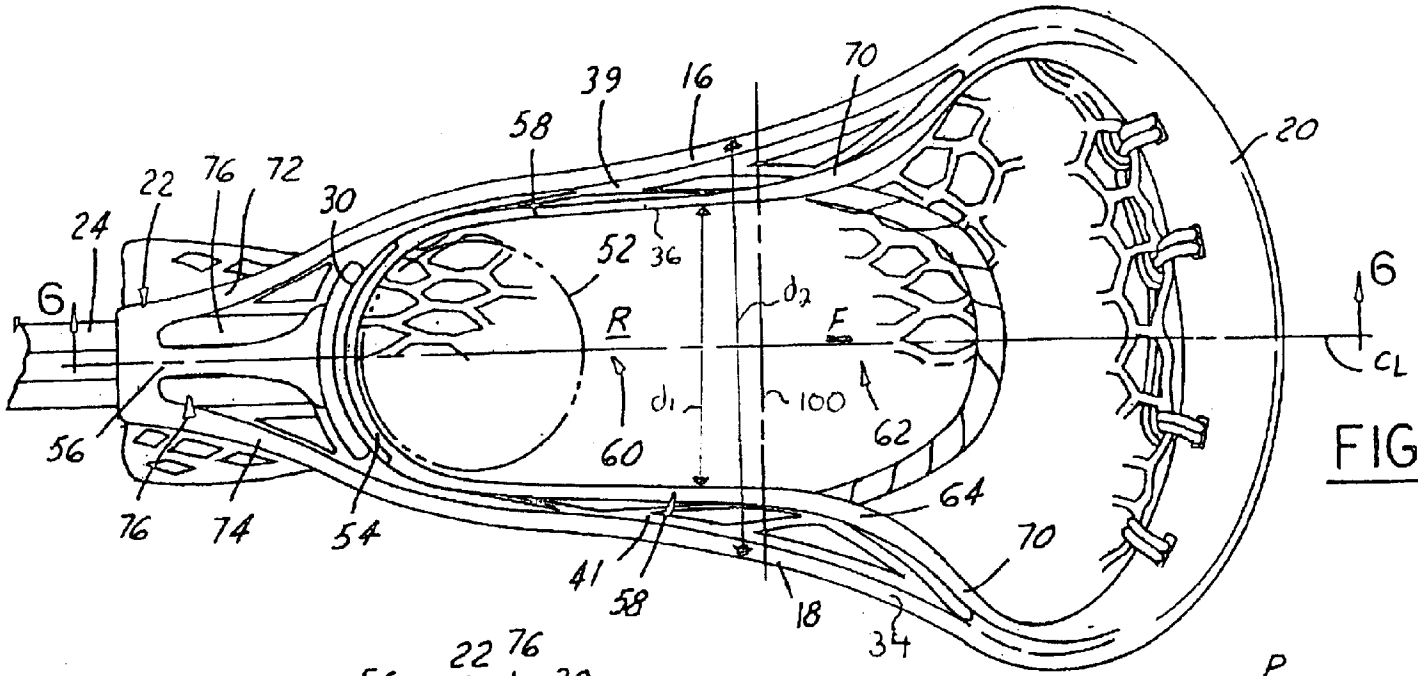
FIG. 3 is top view of a lacrosse head and attached handle with a ball positioned in the head in accordance with a preferred embodiment of the present invention.
Figure 6:
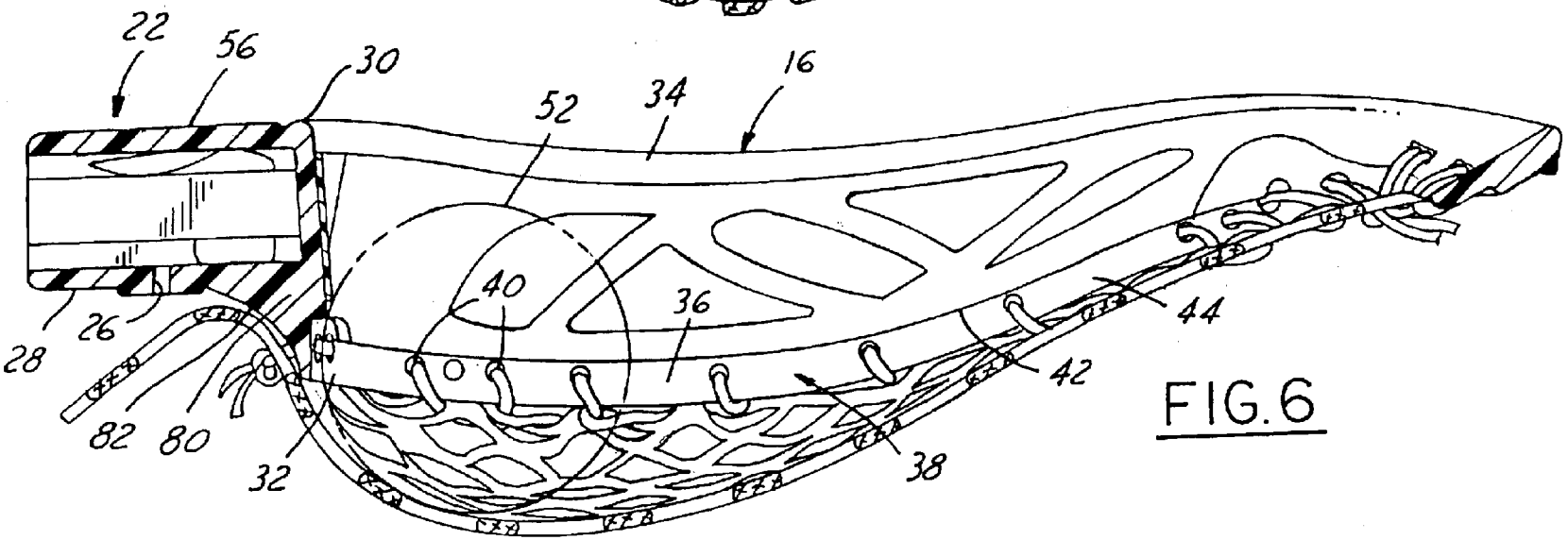
FIG. 6 is a cross-sectioned view of a lacrosse head along the line 6—6 in FIG. 3.

Referring now to FIGS. 3, 4, and 6, which illustrate the relationship of the sidewalls 16, 18 to the socket 22. The upper rim 34 of each of the sidewalls 16, 18 is preferably lowered with respect to a plane P defined by an upper surface 56 of the socket 22. The upper rim 34 of each of the sidewalls 16, 18 is preferably lowered to a distance that is below the upper surface 56 of the socket 22, but remains above a centerline $C_L$ of the lacrosse stick. The upper rim 34 of each of the sidewalls 16, 18 is preferably lowered downwardly in a gradually curving fashion. As is known, the upper rim 34 of each of the sidewalls 16, 18 may be lowered in other manners, such as by a sharp drop-off, or by a step or gradual slanting. It is preferred that the upper rims 34, once lowered to a specified distance remain lowered. Alternatively, the upper rims 34 of each sidewall 16, 18 can curve back or otherwise extend upward toward the plane P.

As shown, each sidewall 16, 18 is preferably configured such that it extends generally outwardly or flares from the lower rim 36 to the upper rim 38. This flaring creates a "pinched" configuration of the sidewalls. The degree to which each sidewall 16, 18 tapers or flares may be entirely uniform from the base 14 to the scoop 20, may progressively increase, may progressively decrease or take on a variety of other configurations. It is preferred, however, that across the length of each sidewall 16, 18 each upper rim 34 is located further outwardly from the corresponding lower rim 36 of each sidewall 16, 18. Additionally, the inner surface 39, 41 of each sidewall 16, 18 located immediately above the recessed channel 38 is also disposed inwardly with respect to each corresponding upper rim 34. Each inner surface 39, 41 is preferably configured to extend in a generally continuous fashion from the top surface 42 of the recessed channel 38 to the upper rim 34. In the preferred embodiment, this configuration is generally curved or arcuate. However, it will be understood that the inner surface 39, 41 of each sidewall may alternatively be sloped, inclined, convex, stepped, or any combination of the above. Moreover, different portions of a single sidewall can take on a variety of different shapes.

Put another way, the distance ($d_1$) between the opposing lower rims 36 of each sidewall 16, 18 is shorter than the distance ($d_2$) between the opposing upper rims 34 of each sidewall 16, 18. However, as discussed in detail below, the difference between $d_2$ and $d_1$ preferably varies as each sidewall 16, 18 extends from the base 14 to the scoop 20.

As shown, each sidewall 16, 18 and the area between each sidewall is broadly divisible into a rear portion 60 adjacent the base 14 and a forward portion 62 adjacent the scoop 20. The division of the sidewalls 16, 18 preferably occurs generally at about the mid-point of the frame element 12. It will be understood that the division of the sidewalls 16, 18 can occur at a variety of other locations.

In the rear portion 60 of the head, the upper rims 34 are flared outwardly a smaller distance with respect to the lower rims 36 than the upper rims 34 are flared outwardly with respect to the lower rims 36 in the forward portion. This also helps create the "pinched" configuration. In other words, the upper rims 34 in the forward portion 62 are flared outwardly more than the upper rims 34 in the rear portion 60. Put another way, the variation in distances $d_2$ versus $d_1$, is greater in the forward section 62 than in the rear section 60 and generally increases from the base 14 to the scoop 20.

The catching area of the lacrosse head 10 is the area defined by the upper rims 34 of the sidewalls 16, 18, the upper rim 30 of the base 14, and the upper rim of the scoop 20. The catching area is functionally the portion of the, head 10 where the lacrosse ball can be received and maintained within the head 10. The catching area is generally defined by the upper portion of the open frame 12. The pocket area of the lacrosse head 10 is the area defined by the lower rims 36 of the sidewalls 16, 18, the lower rim 32 of the base 14, and the scoop 20. The pocket area is functionally the portion of the head where the ball can be maintained in the head and in contact with the netting. However, a player typically carries the lacrosse ball during possession thereof in the rear section 60. In accordance with the preferred embodiment, the catching area is larger than the pocket area. It should be understood that the ball can be carried anywhere in the head, but is best retained in the rear section 60 where the distance between the lower rims 36 of the sidewalls 16, 18 is narrow.

In the rear section 60, the lower rims 36 of each of the sidewalls 16, 18 extend forwardly from the base 14 such that the lower rims 36 are generally parallel to one another. Alternatively, the lower rims 36 may extend from the base 14 in a slightly diverging manner. Similarly, the lower portions 58 of the inner surfaces 39, 41 of each sidewall are preferably configured generally parallel to one another in the rear portion 60. This configuration of the lower rims 36 maintains the area of the netting in the rear portion 60 relatively narrow with respect to the diameter of the lacrosse ball. The upper rims 34 of each of the sidewalls 16, 18 extend forwardly from the base 14 in a more diverging manner than the lower rims 36. The distance between the lower rims 36 of each of the sidewalls 16, 18 is substantially constant in the rear section 60. Similarly, the lower portion 58 of each sidewall inner surface 39, 41 has a distance therebetween which is substantially constant and preferably only slightly larger than the size of a lacrosse ball. The distance between the upper rims 34 preferably slightly diverges to define a catching area that is larger than the pocket area defined by the lower rims 36. Thus, the rear portion 60 is configured to define a narrow pocket area which will facilitate of the ball therein and maximize control because of the minimal width between the lower rims 36 and the lower portion 58 of the inner surfaces of the sidewalls. While the figures illustrate the rear portion 60 as extending generally forward to the mid-point of the head, it will be understood that this is only illustrative. The rear portion 60 can end short of the mid-point or extend beyond the mid-point depending upon the configuration of the sidewall and the size of the pocket area. As also shown in FIG. 3, the upper portions of the sidewalls 16, 18 are disposed outwardly from the lower portions 58 throughout the forward portion (F).

Figure 7:
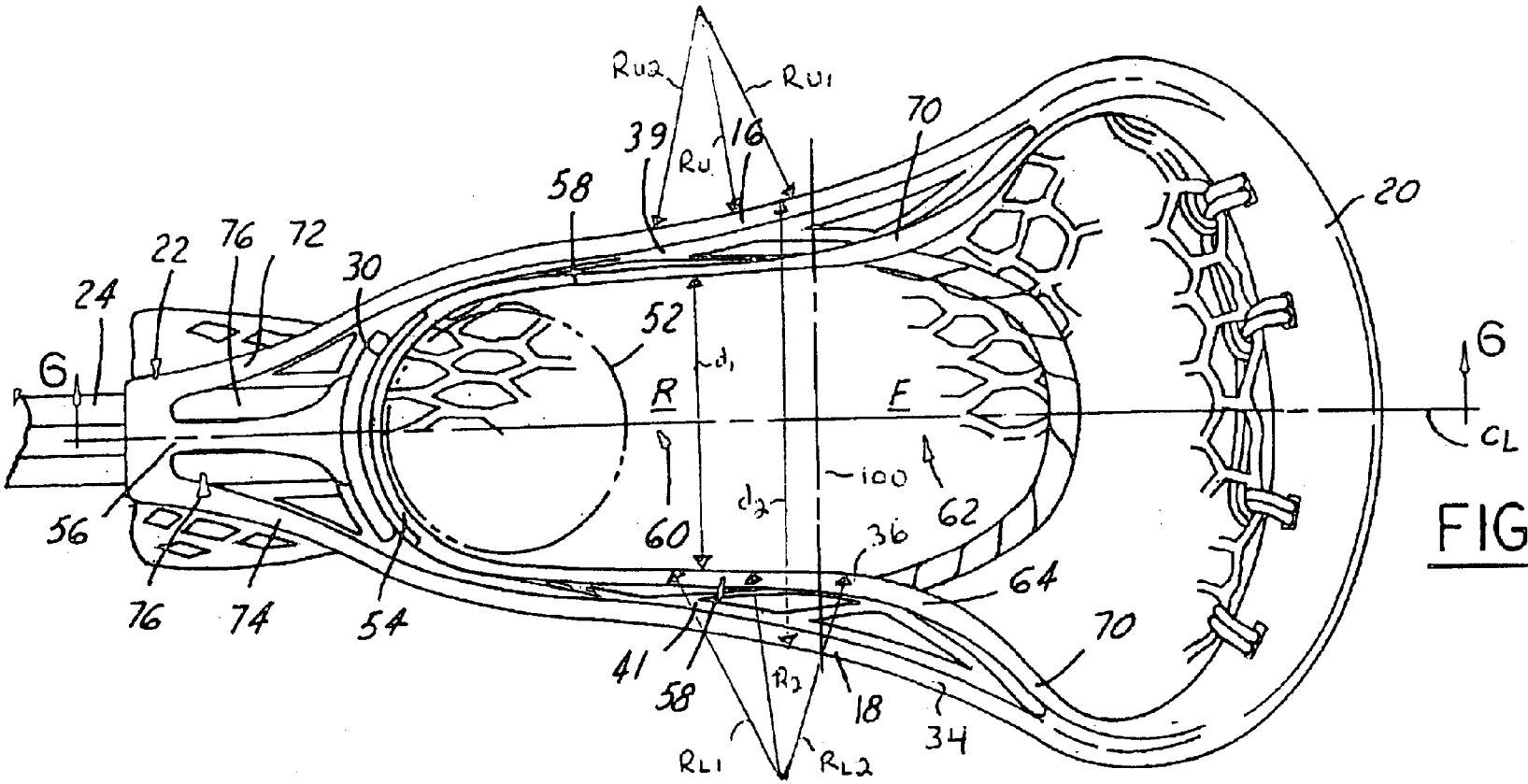
FIG. 7 is another top view of a lacrosse head and attached handle with a ball positioned in the head in accordance with a preferred embodiment of the present invention.

With reference to FIGS. 3 and 7, the distance (d1) between the lower rims 36 is less than the distance (d2) between the upper rims 34 at various locations along the sidewalls 16, 18. Additionally, as shown in FIG. 7, the upper rims 34 of the sidewalls 16. 18 have a first upper radius of curvature $R_u$. The outward radius of curvature of the upper rims 34 with respect to the centerline $C_l$ is generally constant, as generally indicated by $R_{u1}$ and $R_{u2}$, which have generally the same value. The lower rims 36 of the sidewalls 16, 18 have a second lower radius of curvature $R_1$. The outward radius of curvature of the lower rims 36 varies between the base and the scoop, as generally indicated by $R_{11}$, and $R_{12}$, which have different values. As such, the upper rims 34 and the lower rims 36 extend from the base 30 to the scoop 20 at different rates of curvature. The lower rims 36 curve away from the centerline $C_l$ at a rate greater than the rate at which the upper rims 34 curve away from the centerline $C_l$.

By this configuration, the middle or center of the lacrosse ball 52 is maintained generally along the centerline $C_L$ of the stick in the rear portion 60 because there is relatively little room for movement or play between the lower rims 36 to allow the lacrosse ball to move. This results in more accurate shots and passes as the lacrosse ball will be generally located along the same line as the path of travel of the lacrosse stick.

The forward portion 62 generally is defined by the location where the pocket or ball retaining area significantly increases. In the forward portion 62, the upper rims 34 of the sidewalls 16, 18 curve outwardly with respect to the centerline $C_L$ of the stick and also outwardly with respect to the lower rims 36 to form a bend 64 in each sidewall 16, 18. The bend 64 allows the catching area in the forward portion 62 to be increased significantly. This configuration creates a "filleted" appearance to the forward portion 62. The distance between the lower rims 36 is preferably still less than the distance between the upper rims 34 in the forward portion 62. Moreover, the sidewalls 14, 16 extend generally outwardly from the lower rim 36 to the upper rim 34, as discussed above. The recessed channel 38 is preferably located adjacent the lower rim 36 of each sidewall 14, 16 in the forward portion 62. The configuration of the sidewalls 14, 16 in the forward portion 62 as compared to the rear portion 60 allows a lacrosse ball to be easily caught through the open frame 12 and more readily maintained in the narrower rear portion 60. The pocket area is preferably significantly decreased with respect to current heads without decreasing or affecting the catching area.

As best shown in FIG. 3, the sidewalls 16, 18 each preferably have a stiffening ridge 70 formed on a respective inner surface 39, 41 thereof. The ridge 70 or protrusion is preferably located at the lower portion 58 of the sidewalls 14, 16 and extends inwardly. The ridge 70 provides additional strength to support the sidewalls 16, 18 and also helps deflect more balls into the netting. It will be understood that the ridge 70 can be located anywhere along the inner surface 39, 41 of the sidewall 16, 18. If, however, the ridge 70 is located closer towards the upper rims 34, it will decrease the width between the inner surfaces 39, 41 of the sidewalls 16, 18. As also shown in FIG. 3, the ridge or protrusions 70 extends over the intersection between the forward section (F) and the rear section (R), as generally indicated by reference number 100. As discussed above, the net securing means 40 are disposed in the recessed channel 38, which as shown in FIGS. 5 and 6 are disposed further outwardly than the ridge or protrusion 70.

Additionally, the socket 22 preferably has a bridge portion 72, 74 located on either side of the handle 24. Each of the bridge portions 72, 74 is integrally molded to a respective sidewall 16, 18 in order to strengthen the connection of the socket 22 to the frame element 12. This connection through the inclusion of the bridge portions 72, 74 minimizes throat breakage and decreases the amount of deflection that would be present in the head during shooting and passing. This configuration will provide a head with more consistent passing and shooting capabilities. Moreover, because of the inclusion of the bridge portions 72, 74, the socket 22 preferably has a plurality of openings 76 formed at least partially in the upper surface 56 thereof. The openings 76 allow the head 10 to be manufactured with less material, thereby reducing material costs without comprising strength.

The lower surface 28 of the socket 22 preferably has a sinusoidal bridge 80 extending between the socket 22 and the frame element 12. The bridge 80 also minimizes throat breakage that can occur due to a lacrosse head having an offset configuration as well as due to lighter weight heads. The sinusoidal bridge 80 minimizes any forward, or rearward flex in the head to keep it stiff without adding additional material. The lower surface 28 of the socket 22 also preferably has a finger notch 82 formed therein. The finger notch 82 is intended to receive a player's finger therein and thus prevent the player's hand from sliding above the arcuate wall 14 of the head 10.

Having now fully described the invention, it will be apparent to one of ordinary skill in the art that many changes and modifications can be made thereto without departing from the spirit or scope of the invention as set forth herein.

What is claimed:

1. A lacrosse head for attachment to a lacrosse stick, comprising:

a generally v-shaped frame element defining an open area for receiving a lacrosse ball and being broadly divisible into a rear portion and a forward portion, said frame element including:

a base;

a scoop located opposite said base;

a pair of diverging sidewalls extending from said base to said scoop, said sidewalls having an interior surface upper portion and an interior surface lower portion;

said interior surface upper portion and said interior surface lower portion of said sidewalls diverging from said base toward said scoop at different rates of curvature;

wherein at least a portion of each of said sidewalls is outwardly inclined from said lower portion to said upper portion.

2. The lacrosse head of claim 1, wherein said upper portion diverges from said base toward said scoop with a generally constant radius of curvature.

3. The lacrosse head of claim 1, wherein at least a section of said lower portion diverges from said base toward said scoop with a greater radius of curvature than said upper portion.

4. The lacrosse head of claim 1, wherein each of said sidewalls is uniformly outwardly inclined from said lower portion to said upper portion substantially throughout said rear portion.

5. The lacrosse head of claim 1, wherein said lower portions of said sidewalls lie generally parallel to one another substantially throughout said rear portion.

6. The lacrosse head of claim 1, wherein said upper portions of said sidewalls are spaced apart a greater distance than said lower portion of said sidewalls in said rear portion.

7. The lacrosse head of claim 1, wherein said upper portions of said sidewalls are spaced apart a greater distance than said lower portions of said sidewalls substantially throughout said forward portion.

8. The lacrosse head of claim 1, wherein said upper portions of said sidewalls are spaced apart a greater distance than said lower portions of said sidewalls along substantially the entire length of each of said sidewalls.

9. The lacrosse head of claim 1, further comprising:

an outwardly extending recess formed in at least a section of said lower portion of each of said sidewalls for contacting an upper portion of a lacrosse ball.

10. The lacrosse head of claim 9, wherein said recess has a plurality of net attachment structures disposed therein.

11. The lacrosse head of claim 1, further comprising:

an inwardly projecting rib formed on at least a section of an inner surface of said sidewalls being intended to overlie a portion of a lacrosse ball when the head is strung.

12. The lacrosse head of claim 1, wherein said lower portion of each of said sidewalls includes a portion that is disposed further inwardly with respect to an axis defined by a centerline of the head than a corresponding portion of a lower rim of each of said sidewalls.

13. The lacrosse head of claim 1, further comprising:

a socket extending rearwardly from said frame element for receipt of the lacrosse stick.

14. The lacrosse head of claim 13, wherein said socket inclines a bridge portion located on either side thereof that connects said socket to a stiffening rib formed on each of said sidewalls.

15. A lacrosse head for attachment to a lacrosse handle, comprising:

an open generally V-shaped frame having a rearward arcuate wall, a pair of sidewalls that diverge from said arcuate wall, and a scoop that connects said pair of sidewalls opposite said rearward arcuate wall;

said open frame having a rear portion and a forward portion;

a throat portion projecting rearwardly from said open frame and having a socket for receipt of the lacrosse handle therein;

a plurality of net attachment structures associated with said open frame allowing a net to be secured to said open frame;

each of said pair of sidewalls having a lower rim and an upper rim; and an inwardly projecting protrusion formed in at least a portion of each of said sidewalls adjacent said lower rim for contacting an upper portion of a lacrosse ball;

wherein said open frame has a first distance defined by a distance between an inner surface of said upper rims of said sidewalls and a second distance defined by a distance between an inner surface of said lower rims of said sidewalls;

wherein said first distance is greater than said second distance substantially throughout said forward portion.

16. The lacrosse head of claim 15, wherein said lower rims of each of said sidewalls are generally parallel to one another substantially throughout said rear portion.

17. The lacrosse head of claim 15, wherein said upper rims of said sidewalls extend generally downwardly with respect to a plane defined by an upper surface of said arcuate wall.

18. The lacrosse head of claim 15, wherein said upper rims have a generally constant outward radius of curvature with respect to a centerline of the lacrosse handle as they extend from said base toward said scoop.

19. The lacrosse head of claim 15, wherein said lower rims have a greater outward radius of curvature with respect to a centerline of the lacrosse handle than said upper rims as they extend from said base toward said scoop.

20. The lacrosse head of claim 15, wherein a recess area is formed below said inwardly projecting protrusion with said recess area having a plurality of net attachment structures disposed therein.

21. The lacrosse head of claim 15, wherein at least one location in said forward portion has a first distance defined by a distance between said upper rims which is greater than a second distance defined by a distance between said lower rims.

22. The lacrosse head of claim 15, wherein said lower portion of each said sidewalls includes a portion that is disposed further inwardly with respect to an axis defined by a centerline of the head than a corresponding portion of a lower rim of said sidewall.

23. The lacrosse head of claim 15, wherein said upper rims of said sidewalls are spaced apart a greater distance than said lower rims of said sidewalls along substantially the entire length of said sidewalls.

24. The lacrosse head of claim 15, further comprising:

an outwardly extending recess formed in each of said sidewalls adjacent said lower rim for contacting an upper portion of a lacrosse ball.

25. The lacrosse head of claim 15 wherein said inwardly projecting protrusion extends substantially along the length of each of said sidewalls.

26. The lacrosse head of claim 15 wherein said inwardly projecting protrusion extends along each of said sidewalls throughout at least a portion of said forward portion.

27. The lacrosse head of claim 26 wherein said inwardly projecting protrusion extends substantially throughout said forward portion.

28. The lacrosse head of claim 26 wherein said inwardly projecting protrusion extends substantially throughout said rear portion.

29. The lacrosse head of claim 26 wherein said inwardly projecting protrusion extends along a substantial portion of each of said sidewalls.

30. A lacrosse head comprising:

a base;

a scoop;

a throat extending rearwardly from said base for accommodating a lacrosse handle therein, said throat having a centerline defining an axis;

a pair of sidewalls diverging from said base toward said scoop and defining a ball receiving area, each of said pair of sidewalls connected at a first end to said base and at a second end to said scoop, said sidewalls being generally divisible into a forward section and a rear throat section and having an upper rim and a lower rim; and at least one protrusion formed on at least a non-insubstantial portion of a respective inner surface of each of said sidewalls, said at least one protrusion being formed in a lower portion of each of said sidewalls, said lower portion being disposed above said lower rim to allow a lacrosse ball to contact an underside thereof, said at least one protrusion extending inwardly toward said axis.

31. The lacrosse head of claim 30, wherein said at least one protrusion is a longitudinally extending rib.

32. The lacrosse head of claim 30, wherein a recessed channel is formed in each of said sidewalls, said recessed channels being disposed below said respective at least one protrusion.

33. The lacrosse head of claim 32, wherein a plurality of string holes are formed in each of said recessed channels.

34. The lacrosse head of claim 32, wherein a plurality of string holes are formed outwardly from each of said protrusions with respect to said axis.

35. The lacrosse head of claim 30, wherein said at least one protrusion extends substantially along the length of said inner surface of each of said sidewalls.

36. The lacrosse head of claim 30, wherein at least a portion of said protrusion extends over an intersection between said forward section and said rear throat section.

37. The lacrosse head of claim 30, further comprising:

a plurality of net attachment structures disposed below said at least one protrusion.

38. The lacrosse head of claim 37 wherein said plurality of net attachment structures are string holes.

39. The lacrosse head of claim 30, further comprising:

a plurality of string holes formed in said base, said string holes being recessed with respect to a portion of an interior surface of said base.

40. The lacrosse head of claim 38, further comprising:

a plurality of openings formed in said sidewalls, said openings being in addition to said plurality of string holes.

41. The lacrosse head of claim 30 wherein said at least one protrusion extends substantially throughout said forward portion.

42. The lacrosse head of claim 30 wherein said at least one protrusion extends substantially throughout said rear portion.

43. The lacrosse head of claim 30 wherein said at least one protrusion extends along a considerable portion of each of said sidewalls.

44. The lacrosse head of claim 30 wherein said at least one protrusion extends substantially along the entire length of each of said sidewalls.

45. A lacrosse head for attachment to a lacrosse sticks comprising:

a generally V-shaped frame having a base portion, a pair of sidewalls that extend from said base portion, and a scoop that connects said pair of sidewalls opposite said base portion;

said open frame having a rear portion and a forward portion;

a throat portion projecting rearwardly from said open frame and having a socket for receipt of the lacrosse handle therein to define a head/handle axis;

a plurality of net attachment structures associated with said open frame allowing a net to be secured to said open frame;

each of said sidewalls having an upper portion and a lower portion, said upper portions being spaced apart a first distance, said lower portions being spaced apart a second distance wherein said first distance is greater than said second distance at at least one location in both said rear portion and said forward portion.

46. The lacrosse head of claim 45, wherein each said upper portion is an upper rim of said sidewalls.

47. The lacrosse head of claim 45, wherein said lower portions are generally parallel to each other substantially throughout said rear portion.

48. The lacrosse head of claim 45, wherein said first distance is greater than said second distance substantially throughout said forward portion.

49. The lacrosse head of claim 45, further comprising:

a rib formed on at least a portion of a respective inner surface of each of said sidewalls, each of said ribs extending inwardly toward said axis.

50. The lacrosse head of claim 49, wherein said rib is a longitudinally extending rib.

51. The lacrosse head of claim 50, wherein said rib is located adjacent a lower portion of said sidewalls.

52. The lacrosse head of claim 50, wherein a recessed channel is formed in each of said sidewalls, said recessed channel being disposed below said rib.

53. The lacrosse head of claim 50, wherein a plurality of string holes are formed in said recessed channel.

54. The lacrosse head of claim 50, wherein said rib extends substantially along the length of said inner surface of each of said sidewalls.

55. The lacrosse head of claim 49, wherein at least a portion of said rib extends over an intersection between said forward section and said rear throat section.

56. A lacrosse head comprising:

a generally v-shaped frame having an upper portion and a lower portion, said frame being broadly divisible into a rear portion and a forward portion;

a throat portion projecting rearwardly from said open frame and having a socket for receipt of a lacrosse handle therein, said socket having a centerline defining an axis;

a plurality of net attachment structures associated with said open frame allowing a net to be secured to said open frame;

said frame having a section in said rear portion that is generally outwardly inclined from said lower portion to said upper portion with respect to said axis.

57. The lacrosse head of claim 56, wherein said frame includes a base portion, a scoop located opposite said base portion, and a pair of sidewalls extending between said base portion and said scoop.

58. The lacrosse head of claim 57, wherein said pair of sidewalls are generally outwardly inclined with respect to said axis.

59. The lacrosse head of claim 58, wherein said lower portion of each of said sidewalls is generally parallel to each other in said rear portion.

60. The lacrosse head of claim 56, wherein said sidewalls each include an upper run that extends generally downwardly with respect to a plane defined by an upper surface of said socket.

61. A synthetic lacrosse head, comprising:

a generally v-shaped frame, including a base, a scoop, and a pair of sidewalls extending between said base and said scoop;

a socket extending rearwardly from said base for receipt of a lacrosse handle therein to define a head/handle axis;

said pair of sidewalls each having an upper rim, an upper portion, a lower rim, and a lower portion; and a plurality of net attachment structures formed adjacent said lower rim of each of said sidewalls, said plurality of net attachment structures disposed outwardly from said lower portion with respect to said axis; and said upper rim being disposed outwardly from said lower portion with respect to said axis.

62. The lacrosse head of claim 61, wherein said frame is generally divisible into a rear throat portion and a forward portion, wherein said lower portion of each of said sidewalls is generally parallel to one another substantially throughout said rear portion.

63. The lacrosse head of claim 61, wherein each of said sidewalls has a recess formed in an inner surface thereof.

64. The lacrosse head of claim 63, wherein said plurality of net attachment structures are a plurality of string openings and wherein said string openings are formed in said recess.

65. The lacrosse head of claim 64, wherein said recess has an outwardly stepped back configuration.

66. The lacrosse head of claim 64, wherein said recess has an outwardly slanted configuration.

67. The lacrosse head of claim 64, wherein said recess has an outwardly curved configuration.

68. The lacrosse head of claim 64, further comprising:

a plurality of openings formed in said sidewalls, said openings being in addition to said string holes.

69. The lacrosse head of calm 61, further comprising:

a rib formed on at least a portion of a respective inner surface of each of said sidewalls, each of said ribs extending inwardly toward said axis.

70. The lacrosse head of claim 69, wherein said rib is a longitudinally extending rib.

71. The lacrosse head of claim 70, wherein said rib is located adjacent a lower portion of said sidewalls.

72. The lacrosse head of claim 70, wherein a recess channel is disposed beneath said rib.

73. The lacrosse head of claim 62, wherein at least one location in said forward portion has a first distance defined by the distance between said upper rims which is greater than a second distance by a distance between said lower rims.

74. The lacrosse head of claim 73, wherein said first distance is greater than said second distance substantially throughout said forward section.

75. A plastic lacrosse head, comprising:

a generally v-shaped frame, including a base, a scoop, and a pair of diverging sidewalls extending between said base and said scoop;

a socket extending rearwardly from said base for receipt of a lacrosse handle therein to define a head/handle axis;

said pair of sidewalls each having a lower portion and an upper portion, said sidewalls including a depending bend wherein said upper portions are spaced apart a first distance as measured from an interior surface of each of said sidewalls and said lower portions are spaced apart a second distance as measured from said interior surfaces, wherein said first distance is greater than said second distance, and wherein said lower portion has a first radius of curvature and said upper portion has a second radius of curvature with said second radius of curvature being smaller than said first radius of curvature.

76. The lacrosse head of claim 75, wherein said frame is generally divisible into a rear throat portion and a forward portion, wherein said lower portion of each of said sidewalls is generally parallel to one another substantially throughout said rear portion.

77. The lacrosse head of claim 75, wherein said first radius of curvature is generally constant from said base toward said scoop.

78. The lacrosse head of claim 75, wherein each of said sidewalls is generally outwardly inclined substantially throughout said forward portion.

79. The lacrosse head of claim 78, wherein each of said sidewalls is generally outwardly inclined substantially throughout the length of said sidewalls.

80. The lacrosse head of claim 75, further comprising:

an inwardly projecting structure formed on at least a portion of an inner surface of each of said sidewalls, at least a portion of said structure being intended to overlie a portion of a lacrosse head.

81. The lacrosse head of claim 75, wherein said lower portion of each of said sidewalls includes a portion that is disposed further inwardly with respect to an axis defined by a centerline of the head than a corresponding portion of a lower rim of said sidewalls.

82. The lacrosse head of claim 75, further comprising:

an outwardly extending recess formed in at least a portion of said lower portion of each of said sidewalls for contacting an upper portion of a lacrosse ball.

83. The lacrosse head of claim 82, wherein said recess includes a plurality of net attachment structures formed therein.

84. A lacrosse head for attachment to a lacrosse handle, comprising:

a frame element having an arcuate wall, a scoop opposing said arcuate wall, and a pair of sidewalls that generally diverge from said arcuate wall to said scoop, said frame being broadly divisible into a rear throat portion and a forward portion;

a socket extending rearwardly from said frame element for receipt of a handle therein to define a head/handle axis;

a pocket area defined by a lower portion of said arcuate wall and a lower portion of each of said pair of opposing sidewalls; and a catching area defined by an upper portion of said arcuate wall and an upper portion of each of said pair of opposing sidewalls;

whereby said catching area is larger than said pocket area generally at an area overlapping an intersection of said rear throat portion and said forward portion to facilitate entry of the ball into the head.

85. A lacrosse head for attachment to a lacrosse handle, comprising:

a frame element having an arcuate wall, a scoop opposing said arcuate wall and a pair of sidewalls that generally diverge from said arcuate wail to said scoop;

a pocket extending rearwardly from said frame element for receipt of an handle therein to define a head/handle axis;

a pocket area defined by a lower portion of said arcuate wall and a lower portion of each of said pair of opposing sidewalls; and a catching area defined by an upper portion of said arcuate wall as an upper portion of each of said pair of opposing sidewalls;

whereby said sidewalls are generally inclined from said pocket area to said catching area throughout at least a majority of a length of said sidewalls.

86. A lacrosse head, comprising:

a frame element having an arcuate wall, a scoop opposing said arcuate wall and a pair of sidewalls that generally diverge from said arcuate wall to said scoop, said frame element being broadly divisible into a rear section and a forward section;

said sidewalls including an upper portion having an upper run and a lower portion having a lower rim;

a plurality of string holes formed in said sidewalls; and a ball retention mechanism formed adjacent said lower rim of said sidewalls, said ball retention mechanism extending throughout at least a portion of said forward section.

87. The lacrosse head of claim 86 wherein said ball retention mechanism extends substantially throughout said forward section.

88. The lacrosse head of claim 86 wherein said ball retention mechanism extends throughout at least a portion of said rear section.

89. The lacrosse head of claim 88 wherein said ball retention mechanism extends throughout substantially said entire rear section.

90. The lacrosse head of claim 86 wherein said ball retention mechanism extends along a considerable length of each of said sidewalls.

* * * * *

UNITED STATES PATENT AND TRADEMARK OFFICE

CERTIFICATE OF CORRECTION

PATENT NO. : 6,902,501 B2
DATED : June 7, 2005
INVENTOR(S) : David Morrow and Jesse Hubbard It is certified that error appears in the above-identified patent and that said Letters Patent is hereby corrected as shown below:

Column 12,
Line 15, delete "run" and insert -- rim --

Column 14,
Line 19, delete "wail" and insert -- wall --
Line 42, delete "run" and insert -- rim --

Signed and Sealed this

Ninth Day of August, 2005

JON W. DUDAS
*Director of the United States Patent and Trademark Office*